US007028440B2

(12) United States Patent
Brisson

(10) Patent No.: US 7,028,440 B2
(45) Date of Patent: Apr. 18, 2006

(54) MODULAR HOMES

(76) Inventor: Dale Brisson, 33 E. Camino Real Apartment #112, Boca Raton, FL (US) 33432

( * ) Notice: Subject to any disclaimer, the term of this patent is extended or adjusted under 35 U.S.C. 154(b) by 72 days.

(21) Appl. No.: 10/674,043

(22) Filed: Sep. 29, 2003

(65) Prior Publication Data

US 2005/0066587 A1 Mar. 31, 2005

(51) Int. Cl.
*E04B 2/00* (2006.01)

(52) U.S. Cl. ..... 52/439; 52/309.7; 52/309.17; 52/309.16

(58) Field of Classification Search ..... 52/442, 52/439, 309.6, 309.7, 309.17, 309.16, 589.1, 52/561
See application file for complete search history.

(56) References Cited

U.S. PATENT DOCUMENTS 5,404,685 A * 4/1995 Collins ..... 52/309.7
5,729,944 A * 3/1998 De Zen ..... 52/439
5,771,649 A * 6/1998 Zweig ..... 52/405.1
5,924,247 A * 7/1999 Van Horn et al. ..... 52/100
5,996,296 A 12/1999 Bisbee
6,167,624 B1 * 1/2001 Lanahan et al. ..... 29/897.32
6,460,302 B1 * 10/2002 Neuhaus et al. ..... 52/261
6,508,043 B1 1/2003 Bond et al.
6,604,328 B1 * 8/2003 Paddock ..... 52/93.1

* cited by examiner

*Primary Examiner*—Naoko Slack
(74) *Attorney, Agent, or Firm*—Malin, Haley & DiMaggio, P.A.

(57) ABSTRACT

The present invention relates a low cost, highly insulated light weight prefabricated building assembly capable of providing a swift, efficient and economic construction of exterior walls, interior walls and roofs to form a sturdy building assembly. The present invention includes a plurality of exterior wall panels; a plurality of styrofoam exterior connection blocks; the plurality of exterior connection blocks being capable of joining the plurality of exterior wall panels that form an exterior wall of the building; a plurality of roof panels, where the plurality of roof panels form a roof of the building; a plurality of interior wall panels; and a plurality of interior connection blocks. The plurality of interior connection blocks are used to connect the plurality of interior wall panels that form at least one interior wall of the building.

19 Claims, 19 Drawing Sheets

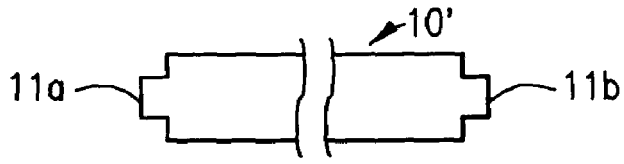
FIG. 4A
FIG. 4B
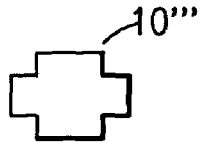
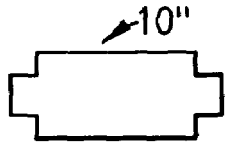
FIG. 4C
FIG. 5A
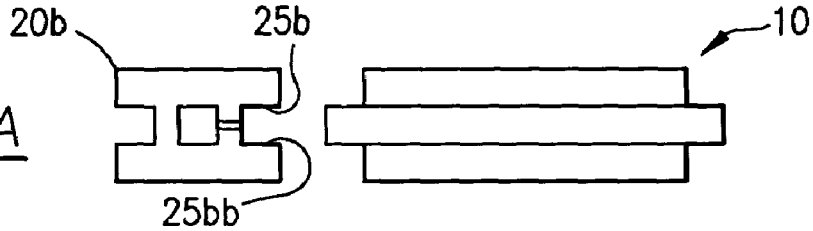
FIG. 5B
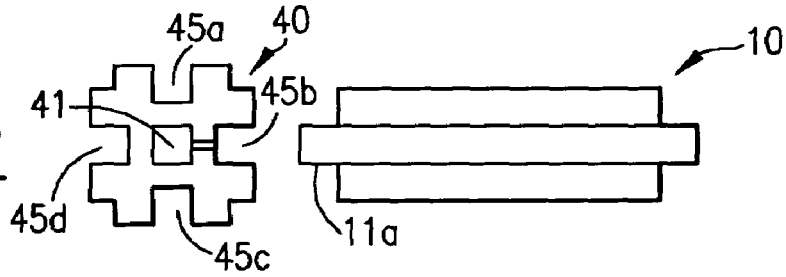
FIG. 5C
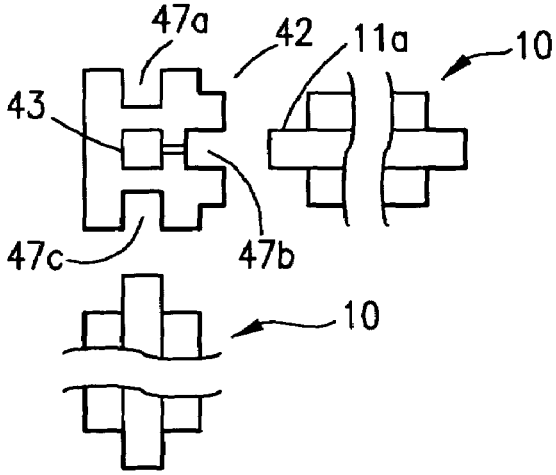

62
11
63
13
63
11
63
60
62a
63
62b
65
65
67

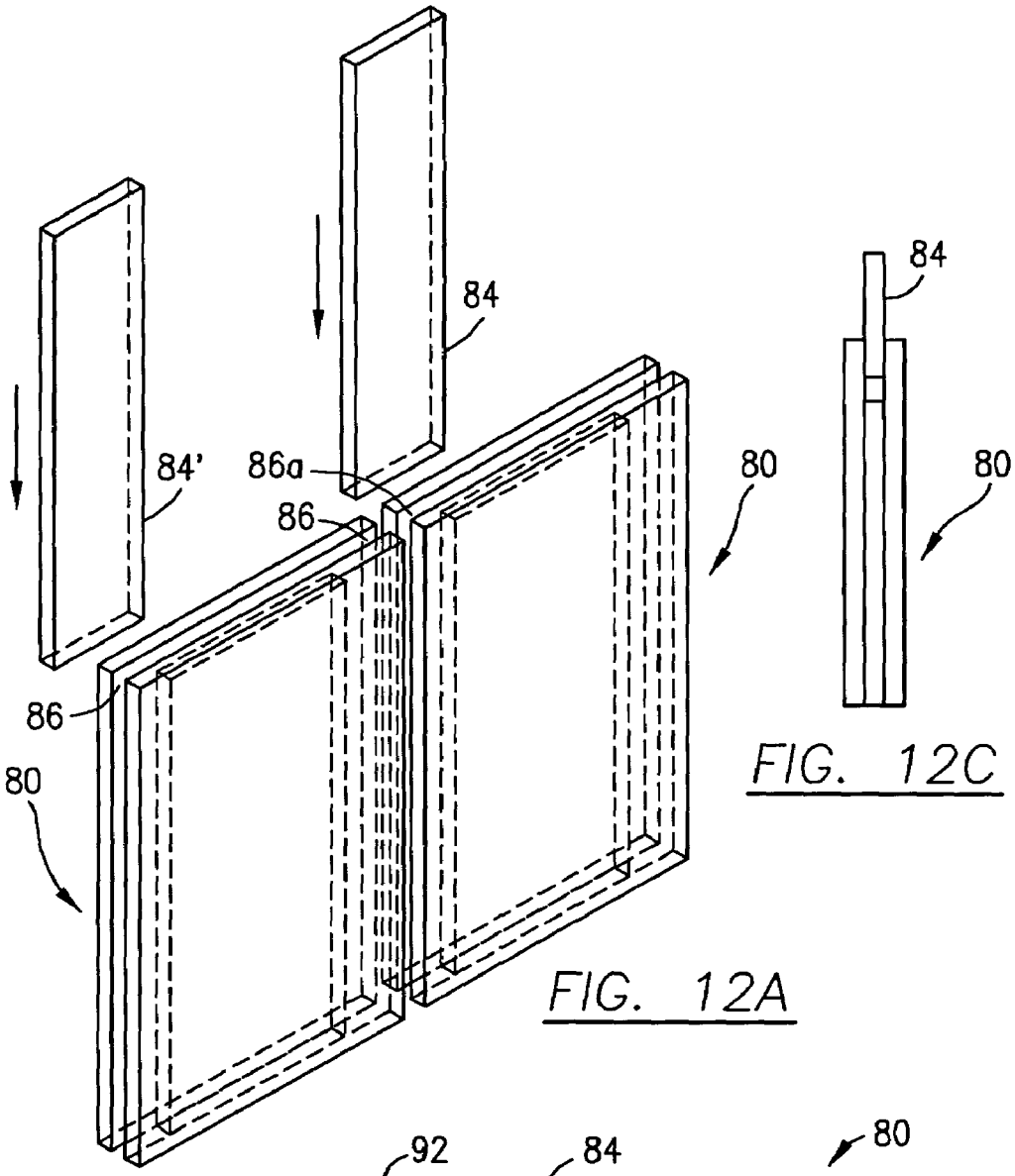
FIG. 12C
FIG. 12A
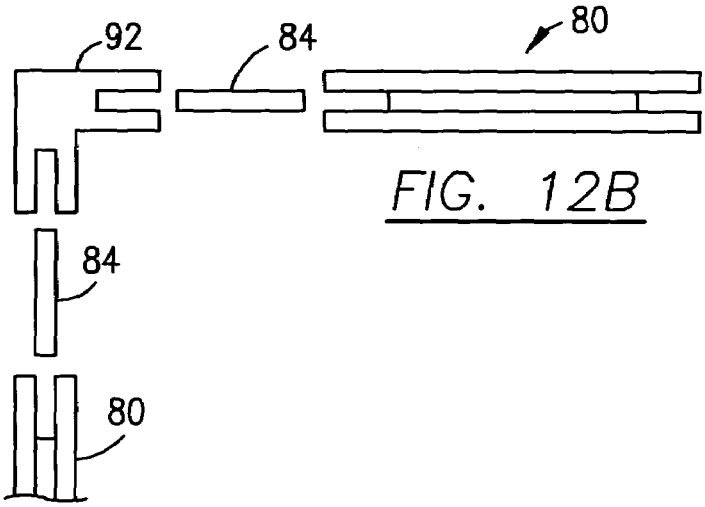
FIG. 12B

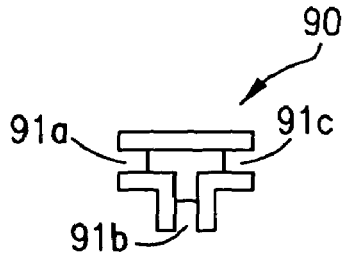
FIG. 13A
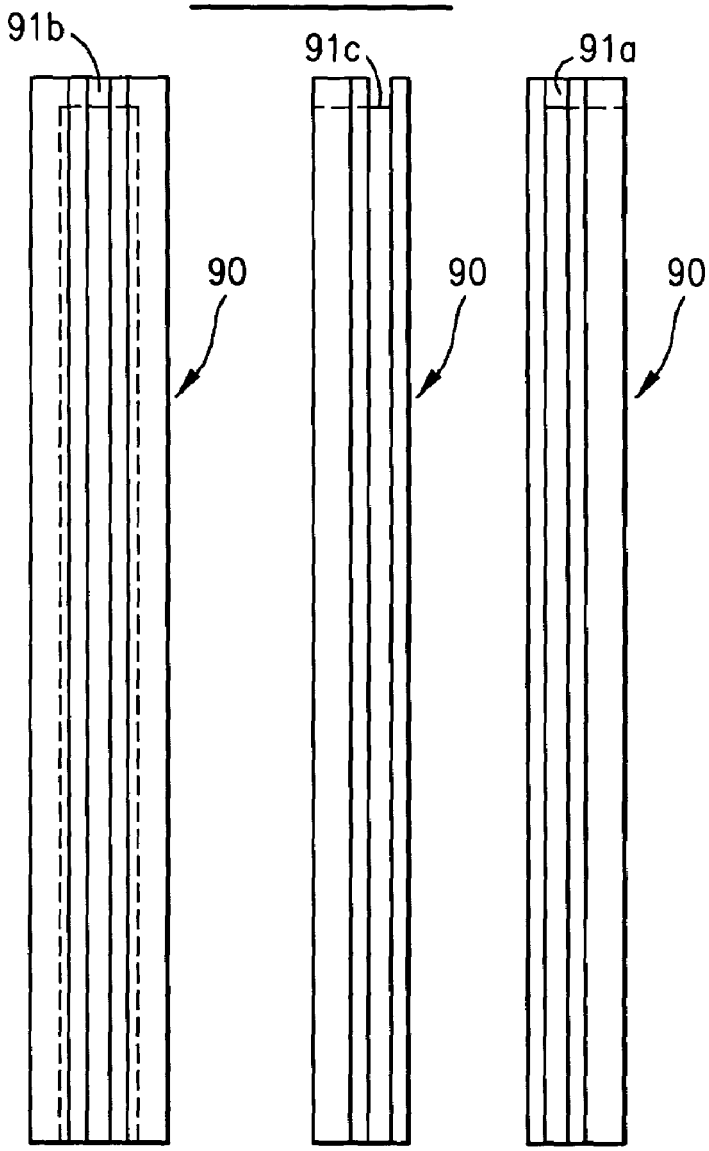
FIG. 13B
FIG. 13D
FIG. 13C

MODULAR HOMES

BACKGROUND OF THE INVENTION

1. Field of the Invention

The present invention relates to a prefabricated building assembly for efficient low cost fabrication of exterior walls, interior walls and roofs to form a building assembly.

2. Description of Related Art

Many techniques have been utilized to reduce building costs associated with conventional building construction. Normally, conventional building construction involves a labor intensive process where skilled workers and laborers may pour a concrete foundation, assemble a wall and roof stud assembly, attach exterior and interior walls, assemble roof panels, and set and install windows and doors. On many occasions, the construction of the building may involve numerous contractors and subcontractors who are responsible for various stages of construction. Typically, delays ensue and construction costs escalate accordingly.

One of the existing techniques used to reduce construction costs involves the use of pre-fabricated modular type homes. Typically, modular homes involve the use of panels, which are shipped to a construction site and only require the connection of the pre-fabricated panels in order to construct the building. The use of pre-fabricated panels provides a less expensive and easily assembled building as opposed to the conventional construction methods. One drawback associated with modular buildings, modular homes tend to lack sufficient strength and durability for long-term use. Modular homes also tend to lack the necessary flexibility to accommodate various sizes and styles. Furthermore, some modular systems require the inclusion of traditional construction techniques in order to complete construction, therefore, escalating the reduced costs associated with modular homes.

U.S. Pat. No. 5,996,296 to Bisbee relates to a structural panels for a pre-fabricated building and a corresponding method that includes a plurality of space tubular steel columns, a pair of tubular steel girts each interconnecting respective ends of the columns and the plurality of space tubular steel cross members arranged in pairs, and connected on opposite sides of the columns in a registry with each other to accommodate various available building materials. The pre-fabricated structural panel of Bisbee addresses some of the strength and durability shortcomings of the prior art, however, the panels may still be costly to assemble and may be somewhat limited in use in regard to design and style.

U.S. Pat. No. 6,508,043 to Bond, et al. relates to a building construction system that is configured to comprise a modular, transportable construction kit type structure, which can be easily provided to a particular building site and has the capability of being expandable into a variety of different configurations depending upon the particular needs for a particular building. The building construction system of Bond includes vertical frame members that are used in conjunction with a plurality of corrugated material panels and a quantity of concrete. The building construction system of Bond attempts to address the cost and efficient construction associated with building construction. Furthermore, it attempts to provide a more sturdy and durable building than associated with the pre-fabricated modular homes of the prior art. The building construction system of Bond, however, still requires extensive labor, and therefore does not reduce costs sufficiently in order to provide a complete substitute for traditional construction methods.

Accordingly, a need exists for an improved modular panel assembly system, which truly addresses the shortcomings of the prior art. More specifically, it would be advantageous to have a pre-fabricated building assembly that allows for cost effective building construction, flexibility to accommodate various designs, and sufficient re-enforcement capabilities to provide durable building construction.

SUMMARY OF THE INVENTION

The present invention relates to a prefabricated building assembly capable of providing a swift, efficient and economic construction of exterior walls, interior walls and roofs to form a building assembly. The present invention includes interlocking prefabricated panels that may form a building assembly comprised of exterior walls, interior walls and a roof. The system may be assembled in its entirety, or the wall and roof system may be utilized independently of each other and adapted to include standard building materials (i.e. standard roof trusses, interior framing, exterior block walls).

The interlocking panels may be constructed primarily of expanded polystyrene components to build exterior walls, interior walls and an interlocking roof system for high insulation benefits and light weight. The wall components may consist of "H" blocks, "corner blocks" and "interlocking panels." The building panels may be sized differently in length or height to accommodate the specifications of a given plan. Once erected, the walls having vertical voids in the wall system may receive steel rebar, be filled with a cementitious material and/or any other suitable matter. The interlocking roof panels are attached to each other to form a roof assembly and include channels that receive steel rebar and concrete that provide a means to adjoin to the wall assembly thus forming the building assembly. Mechanical and utility chases may be placed within the building assembly panels and standard building materials may be secured to the structure. Once completed, the entire surface area of the panels will be encapsulated with a cementitious mixture that bonds to the surface and enhances the structures impact resistance, rigidity and strength.

It is therefore an object of the present invention to provide a prefabricated building assembly necessary for construction of a building comprising: a plurality of exterior wall panels; a plurality of exterior connection blocks, the plurality of exterior connection blocks being capable of joining the plurality of exterior wall panels that form an exterior wall of the building; a plurality of roof panels, the plurality of roof panels forming a roof of the building; a plurality of interior wall panels; and a plurality of interior connection blocks where the plurality of interior connection blocks being capable of joining the plurality of interior wall panels that form at least one interior wall of the building.

It is also another object of the present invention, to provide a prefabricated building assembly necessary for construction of a building which includes exterior wall panels, exterior connection blocks, the exterior connection blocks being made to join the exterior wall panels that form an exterior wall of the building, roof panels that form a roof of the building, interior wall panels, and interior connection blocks capable of joining the interior wall panels that form at least one interior wall of the building. A polymer may be used to form the exterior wall panels, interior wall panels, exterior connection blocks, interior connection blocks and roof panels. A cementitious coating may be applied to the wall panels and connection blocks in order to bond the surface and to enhance the impact resistance, rigidity and strength.

In accordance with these and other objects which will become apparent hereinafter, the instant invention will now be described with particular reference to the accompanying drawings.

BRIEF DESCRIPTION OF THE DRAWINGS

FIG. 4A shows a top plan view of an exterior wall panel of indeterminent length.

FIGS. 4B and 4C show top plan views of special spacers that may be used in the invention.

FIG. 5A shows a top plan exploded view of the use of the H block with the exterior wall panel according to the present invention.

FIG. 5B shows a top plan exploded view of a four-way block used in conjunction with the exterior wall panel according to the present invention.

FIG. 5C shows a top plan exploded view of a three-way block used in conjunction with the exterior panel according to the present invention.

FIG. 12A shows a perspective view partially exploded of the connection of two interior panels according to the present invention.

FIG. 12B shows a top plan view exploded of a connection of corner block with an interior wall panel according to the present invention.

FIG. 12C shows a top plan view of an interior wall panel and connection.

FIG. 13A shows a top plan view of the interior T block according to the present invention.

FIG. 13B shows a front elevational view of the interior T block according to the present invention.

FIG. 13C shows a right side elevational view of the interior T block according to the present invention as shown in FIG. 13A.

FIG. 13D shows a left side elevational view of the interior T block according to the present invention shown in FIG. 13A.

DETAILED DESCRIPTION

The present invention relates to a prefabricated building assembly for efficient low cost fabrication of a building structure. The present invention uses a number of components in a number of different configurations in order to meet any specifications associated with exterior walls, interior walls and wall panel systems for window and door openings. The present invention also includes interlocking panels designed to form a roof assembly that may complete the shell of the building structure.

Figure 1A:
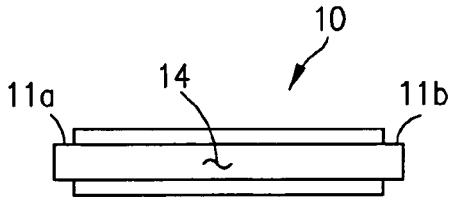
FIG. 1A shows a top plan view of an exterior wall panel according to the present invention.
Figure 1B:
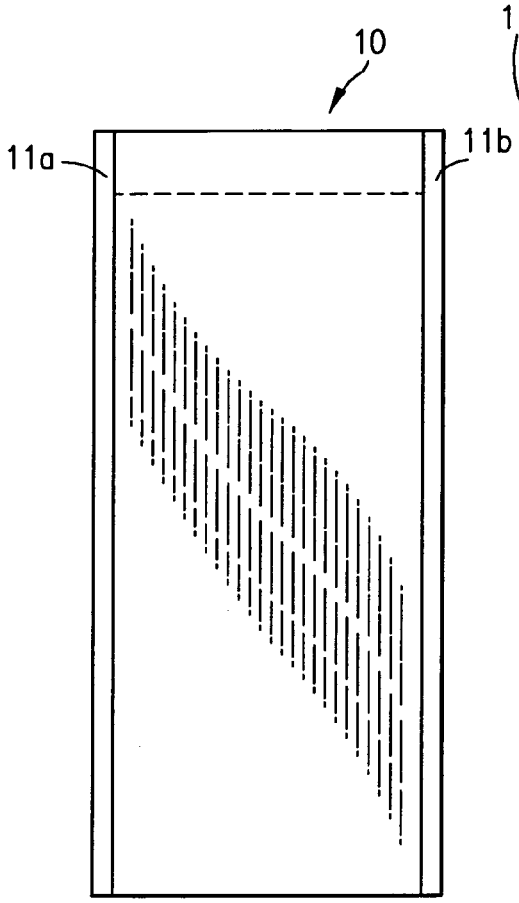
FIG. 1B shows a front elevational view of the exterior wall panel according to the present invention.
Figure 1C:
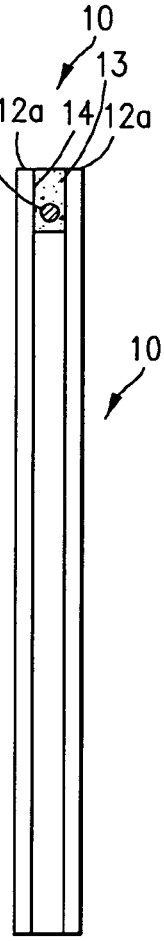
FIG. 1C shows a side elevational view of the exterior wall panel according to the present invention.
Figure 1D:
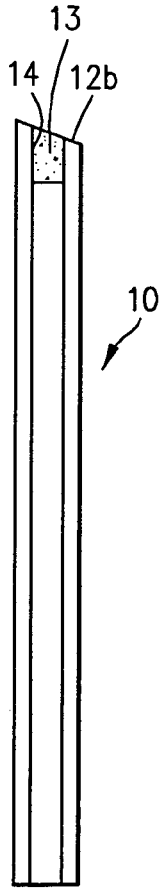
FIG. 1D shows another side elevational view of an exterior wall panel according to the present invention for a 4/12 pitch roof.
Figure 1E:
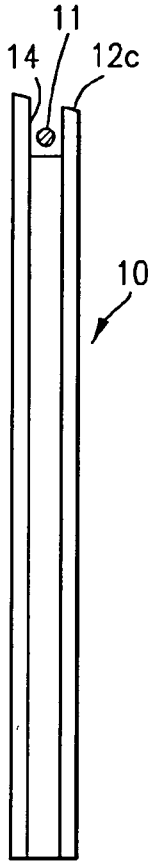
FIG. 1E shows yet another side elevational view of the exterior wall panel according to the present invention for a 5/12 pitch roof.
Figure 1F:
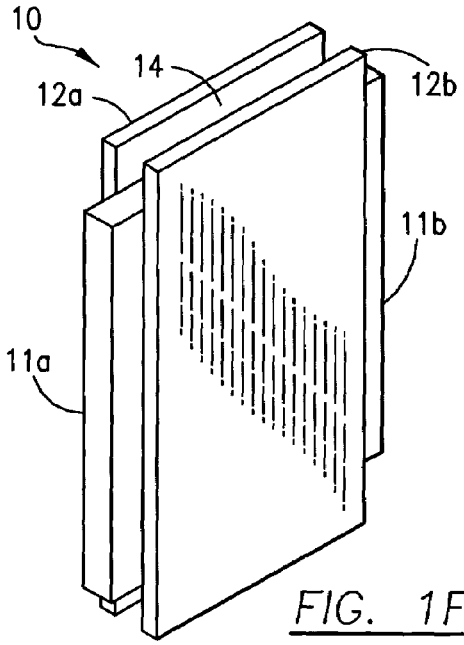
FIG. 1F shows a perspective view of an exterior wall panel according to the present invention.

FIG. 1A shows a top view of an external wall panel 10 according to the present invention. The exterior wall panel 10 includes two interlocking edges 11*a*, 11*b* and recess 14. FIG. 1B shows a front view of the exterior wall panel 10 as can be seen from both FIGS. 1A and B, interlocking edges 11*a*, 11*b* extend outwardly from the external wall panel 10 and provide a means for interlocking the exterior wall panels to "H" blocks or corner blocks to form a complete wall for a building's exterior. FIG. 1C provides a side view of the exterior wall panel 10 and recess 14 which provides a means for insertion of steel and/or cementitious material. The top of the exterior wall 10 includes two lips 12*a*, which form the recess 14. As shown in FIG. 1C, the two lips 12*a* are on the same plane. FIGS. 1D and 1E show the top lip portions of the exterior wall 12*b* and 12*c* which are pitched. Regardless of the lip position, the top recess 14 allows for the insertion of steel rebar and/or cementitious material. Ties may be used to connect rebar within the recess 14 with rebar found within the roof panels and/or ceilings and rebar protruding through the blocks from the slab. The pitched lips 12*b* and 12*c* of FIGS. 1D and 1E allow for the exterior panel 10 to abut against a gable style roof of different pitches. FIG. 1F shows the exterior wall panel 10 and interlocking edges 11*a* and 11*b* and recess 14.

FIG. 1C shows the placement of rebar 11 that is surrounded by cementitous material 13 in recess 14 of the wall structure 10 which is used to connect the wall 10 to the roof which is described herein. FIG. 1D shows a wall structure with only cementitous material in space 14 while FIG. 1E shows a rebar that can be placed in space 14.

Figure 2A:
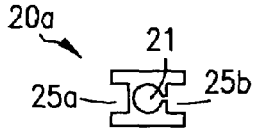
FIG. 2A shows a top plan view of an exterior H block according to the present invention.
Figure 2B:
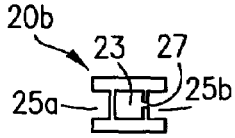
FIG. 2B shows a top plan view of an alternative H block according to the present invention.
Figure 2C:
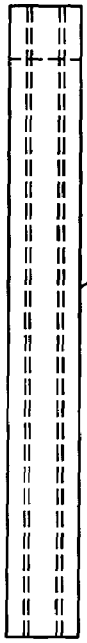
FIG. 2C shows a front elevational view of the exterior H block according to the present invention.
Figure 2D:
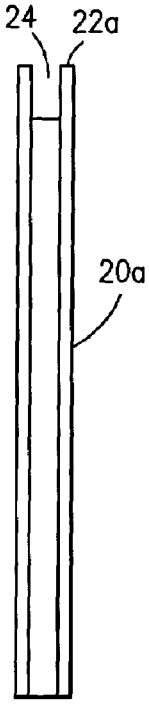
FIG. 2D shows a side elevational view of the exterior H block according to the present invention.
Figure 2E:
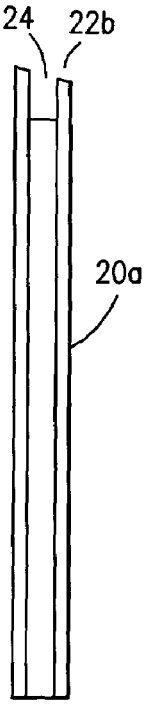
FIG. 2E shows another side elevational view of exterior H block according to the present invention with a roof pitch.
Figure 2F:
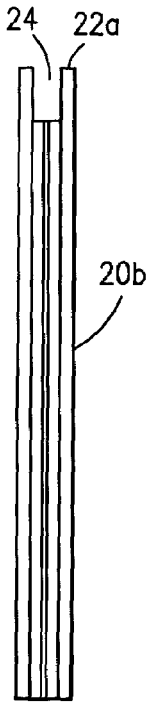
FIG. 2F shows a side elevational view of the alternative exterior H block according to the present invention.
Figure 2G:
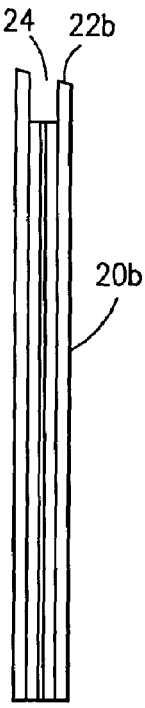
FIG. 2G shows another side elevational view of the alternative H block according to the present invention.
Figure 2H:
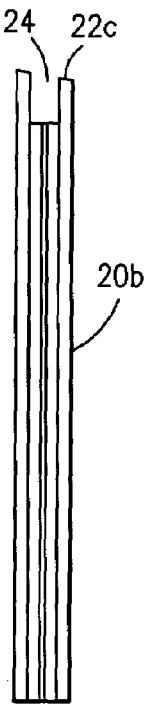
FIG. 2H shows another side elevational view of the alternative exterior H block according to the present invention.

FIGS. 2A through 2H show two embodiments and associated views of an exterior "H" block which provides the interconnecting means for exterior wall panels 10. FIG. 2A shows an exterior H block 20*a* from a top view. The exterior H block 20*a* includes two channels 25*a*, 25*b* with a cylindrical void 21 between the channels 25*a*, 25*b*. The channels 25*a*, 25*b* provide the space as a female fitting for the insertion of male interlocking rectangular edges 11*a*, 11*b* of the exterior wall panel 10. The cylindrical passage or void 21 provides a space for insertion of a rebar and/or a concrete mixture in order to provide further support of the completed wall panel assembly. FIG. 2B shows an alternative exterior H block 20*b*, which includes channels 25*a* and 25*b* as shown with the exterior H block 20*a*. The exterior H block 20*b*, however, includes a rectangular passage or void 23 that has a slot opening 27 on the channel 25*b*. The exterior H block 20*b* merely provides an alternative H block for the vertical insertion of rebar. FIG. 2C shows a front view of the exterior H block 20*a*. FIGS. 2D and 2E show side views of the exterior H block 20*a*. As can be seen in FIGS. 2D and 2E, exterior H block 20*a*, 20*b* includes a connection slot 24 and provides for two alternative top portions. The top portion of exterior H block 20*a*, 20*b* of FIG. 2D is similar to the top portion of 12*a* of the exterior wall panel 10. FIGS. 2F, 2G and 2H show side views of exterior H block 20*b*. Exterior H block top portion 22*a* shows two substantially parallel lips that form connection slot 24. Exterior H block top portion 22*b* shows two pitched lips of the connection slot 24. The slot 24 receives rebar and/or concrete. FIG. 2F has the exterior H block top portion 22*a* with two substantially parallel lips forming connection slot 24. FIGS. 2G and 2H show two alternative exterior H block tops 22*b* and 22*c*, which have pitched lips forming connection slot 24. The exterior H block top portions 22*b*, 22*c* may be used to abut a roof of varying pitch according to the present invention.

Figure 3A:
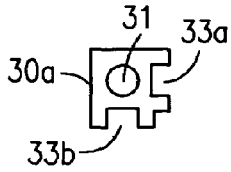
FIG. 3A shows a top plan view of the corner block according to the present invention.
Figure 3B:
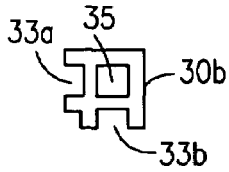
FIG. 3B shows a top plan view of an alternative corner block according to the present invention.
Figure 3C:
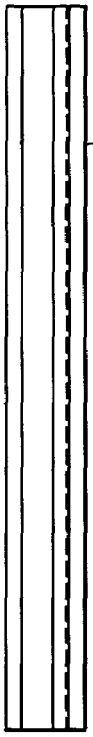
FIG. 3C shows a side elevational view of the corner block according to the present invention.
Figure 3D:
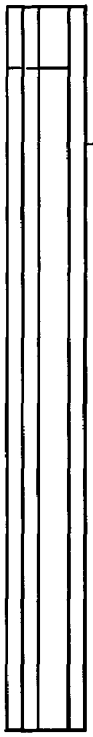
FIG. 3D shows a second side elevational view of the corner block according to the present invention.
Figure 3E:
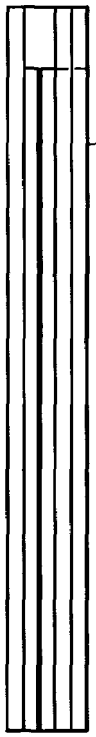
FIG. 3E shows a second side elevational view of the alternative corner block according to the present invention.
Figure 3F:
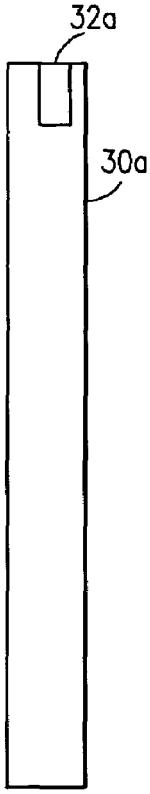
FIG. 3F shows a third side elevational view of the corner block according to the present invention.
Figure 3G:
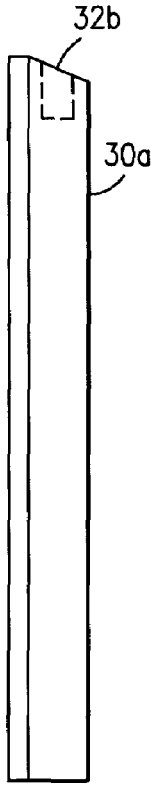
FIG. 3G shows another third elevational side view of the corner block according to the present invention.
Figure 3H:
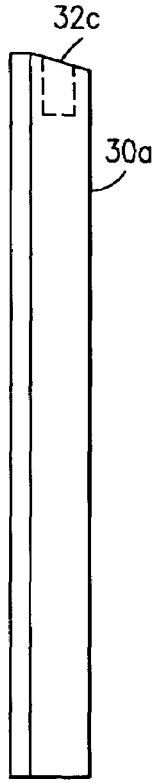
FIG. 3H shows another third side elevational view of the alternative corner block according to the present invention.

FIGS. 3A through 3H show an exemplary corner block 30*a* and 30*b* according to the present invention. FIG. 3A shows corner block 30*a* that includes channels 33*a* and 33*b* on two adjacent sides of the corner block 30*a* and a cylindrical void 31 through the middle of the corner block 30*a*. The channels 33*a*, 33*b* provide space to receive the extended male portions of the exterior wall panels 10 and cylindrical void 31 provides a space for the insertion of rebar and/or cementitious mixture. FIG. 3B shows alternative corner block embodiment that provides a rectangular void 35 through the middle of the corner block 30*b*. The corner block 30*b* also includes channels 33*a* and 33*b* for the insertion of exterior wall panel interlocking edges 11*a*, 11*b*. FIGS. 3C, 3D and 3E show side views of exemplary corner blocks 30*a*, 30*b*. FIG. 3F shows yet another side view of the corner block 30*a*, 30*b* that includes a top slot 32*a* which provides the space for vertical connection of exterior panels 10 or additional corner blocks 30*a*, 30*b*. Steel rebar and concrete may be inserted into the top slot 32*a*. FIGS. 3G and 3H show corner blocks that include top portions 32*b*, 32*c* which are pitched to provide the angle to abut roof panels of the complete building assembly.

The formation of the exterior walls begins with use of the corner block 30*a*, 30*b*. The corner block 30*a*, 30*b*, exterior H block 20*a*, 20*b* and exterior wall panels 10 are preferably designed to be approximately 8' in height. However, the height can vary dependent on the particular construction. The exterior H block 20*a*, 20*b* and the corner blocks 30*a*, 30*b* may contain a cylindrical void 31 that is approximately 4" in diameter that runs the entire height of the block. The cylindrical void diameter can vary. Channels 33*a*, 33*b* are cut into the corner block 30*a*, 30*b* and the exterior H block 20*a*, 20*b* as to directly correlate with the walls direction. The channels 33*a*, 33*b* measuring approximately 3" in depth and 4" in width are cut so as not to encroach into the cylindrical void 31 and also run perpendicular to the cylindrical void 31 through the full height of the corner block. The exterior wall panels 10 and connection blocks include the recess 14 within the top portion of the exterior wall panels 10, where the recess 14 receives steel and/or a cementitious material for connection purposes.

A bonding adhesive may be placed on a mounting slab, not shown, where the corner block 30*a*, 30*b*, H block 20*a*, 20*b* or the exterior wall panels 10 are mounted. The corner block 30*a*, 30*b* may be affixed to the slab by applying the bonding adhesive between the corner block 30*a*, 30*b* and slab, and sliding the corner block 30*a*, 30*b* over an existing rebar that has been secured to the slab.

Once the corner block 30*a*, 30*b* is in place, an adhesive may be applied to the channel 33*a*, 33*b* of the corner block and applied to the interlocking edge 11*a*, 11*b* of the exterior wall panel 10. The exterior wall panel 10 is placed upon the adhesive and over any existing mechanical stubouts. The exterior wall panel 10 may receive recesses to accommodate the stubouts. The interlocking edge 11*a*, 11*b* of the exterior wall panel 10 is inserted into the channel 33*a*, 33*b* of the corner block 30*a*, 30*b*. The sizes of the exterior wall panels 10 may be fabricated in various spans to accommodate desired specifications.

Once the exterior wall panel 10 has been interlocked and secured an H block 20*a*, 20*b* is added to the other interlocking edge 11*a*, 11*b* of the exterior wall panel 10. The interlocking edge 11*a*, 11*b* of the exterior wall panel 10 receives the adhesive and the H block 20*a*, 20*b* is placed over or vertically slide onto the existing steel rebar that is protruding from the slab. The H block 20*a*, 20*b* will also contain channels 25*a*, 25*b* on both sides.

FIG. 4A shows an exemplary exterior wall panel 10 of indeterminent length. FIGS. 4B and 4C special spacers, 10''' and 10" of different lengths, respectively. As can be seen from FIG. 4A, the exterior wall panels 10 may be designed in various lengths in order to meet specifications and building requirements associated with the building assembly. All the exterior wall panels 10 regardless of length include the interlocking edges 11*a*, 11*b* that interlock with the above-described H blocks and corner blocks as a connection means.

FIG. 5A shows the interlocking of the exterior wall panels 10 with an alternative exterior H block 20*b*. An adhesive material is applied to the interlocking edge 11*a* and the channel 25*b* as shown in FIG. 5A. The adhesive 25*bb* provides a means to glue and permanently affix the exterior wall panel 10 to the alternative exterior H block 20*b*. FIG. 5B shows the interconnection of a four-way block 40 with the exterior wall panel 10. The four-way block 40 includes four channels 45*a*, 45*b*, 45*c* and 45*d*, all of which provide a means for the insertion of interlocking edges 11*a*, 11*b* of the exterior wall panel 10. As discussed above in relation to the H block 20*b*, adhesive is applied within the channels specifically channel 45*b* as shown in FIG. 5B, and to the interlocking edge 11*a* of the exterior wall panel 10. FIG. 5C shows yet another exemplary block, specifically a three-way block 42. The three-way block 42 includes three channels 47*a*, 47*b*, and 47*c*. The channels of the three-way block 42 provide a female space for the insertion of male interlocking edges 11*a*, 11*b* of the exterior wall panel 10. Rectangular void 41 and rectangular void 43 are provided for the four-way block 40 and three-way block 42 respectively. Rectangular voids 41, 43 provide a space for insertion of rebar and/or concrete mixture for additional structural support of the external wall panel assembly. Rectangular voids 41, 43 are not limited to a rectangular or square, the voids 41, 43 may be circular or any other shape as desired.

Figure 6A:
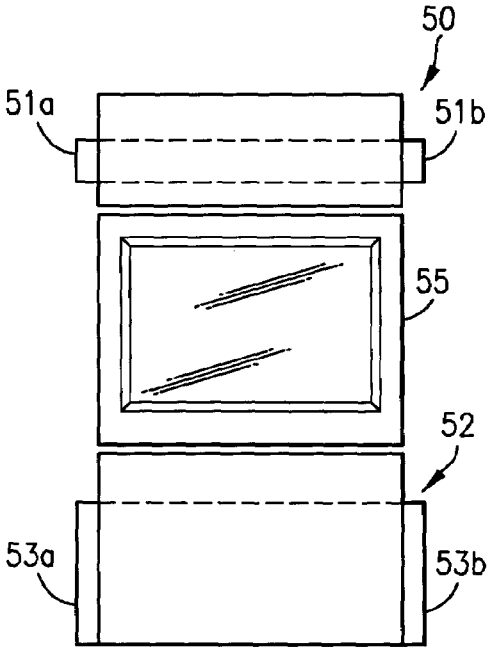
FIG. 6A shows a front elevational exploded view of a window and sill/header panel according to the present invention.
Figure 6B:
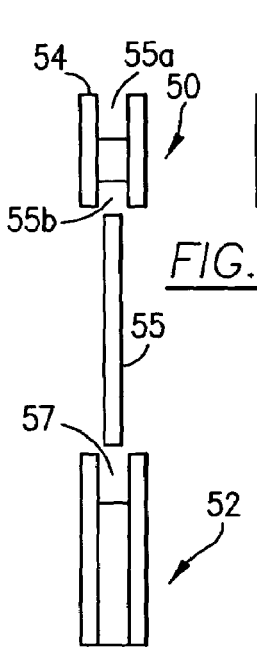
FIG. 6B shows a side elevational exploded view of the window sill/header panel according to the present invention.
Figure 6C:
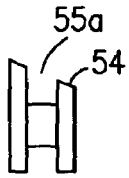
FIGS. 6C and 6D show side elevational views of exemplary headers of different pitches according to the present invention.
Figure 6D:
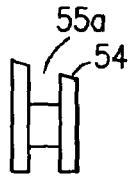

FIGS. 6A, 6B, 6C and 6D show the exterior window sill/header panel detail. FIG. 6A shows the header 50, window 55 and sill panel 52 assembled with a front view. As can be seen, header panel 50 includes interlocking edges 51*a* and 51*b* and sill panel 52 includes interlocking edges 53*a* and 53*b*. FIG. 6B shows a side view of the window sill/header panel connection. As can be seen, the header 50 includes female slots 55*a* and 55*b*. The sill slot 55*a* provides a space for the insertion of steel rebar and/or cement and slot 55*b* provides a space for the insertion of window 55. The spaces are filled with concrete after a form is placed on the sill opening. The window is attached directly to the concrete once the form is removed. Sill panel 52 includes slot 57 for the insertion of window 55 and the completion of the sill/window/header panel. FIGS. 6C and 6D provide alternative header configurations where the top of header 50 is pitched for abutting against a roof and/or ceiling of the building assembly.

Window openings are created through the use of the header panel 50 and sill panel 52 with the use of two H blocks 20*a*, 20*b*. Door openings are created through the use of header panels flanked by H blocks. The header panel 50 and sill panel 52 are sized according to desired heights in order to create the desired window. The two H blocks support the header panel 50 and sill panel 52. The header panel 50 and sill panel 52 also receives adhesive and are slidably adjustable within the H block channels 55*a*, 55*b* until the respective panels desired heights are attained, thus creating a window or door opening.

The above process continues until the entire perimeter of the wall is complete. Steel rebar may be added to the bond beam and fastened to any protruding rebar. Forms may also be placed around the window, door openings and headers, and a cementitious material (concrete) will fill any voids created in the wall assembly. The components of the building assembly including the exterior wall panels, interior wall panel, roof panels and corner connectors and posts are made from any suitable polymer such as polystyrene or polyurethane for high insulation, light weight concerns. The connection blocks advantageously include vertical channels that may receive rebar and/or concrete to provide further reinforcing means. The exterior surface may be coated with a substance such as polyurea or even cementious mixture in order to bond the surface and provide further rigidity and strength.

Figures 7A, 7B:
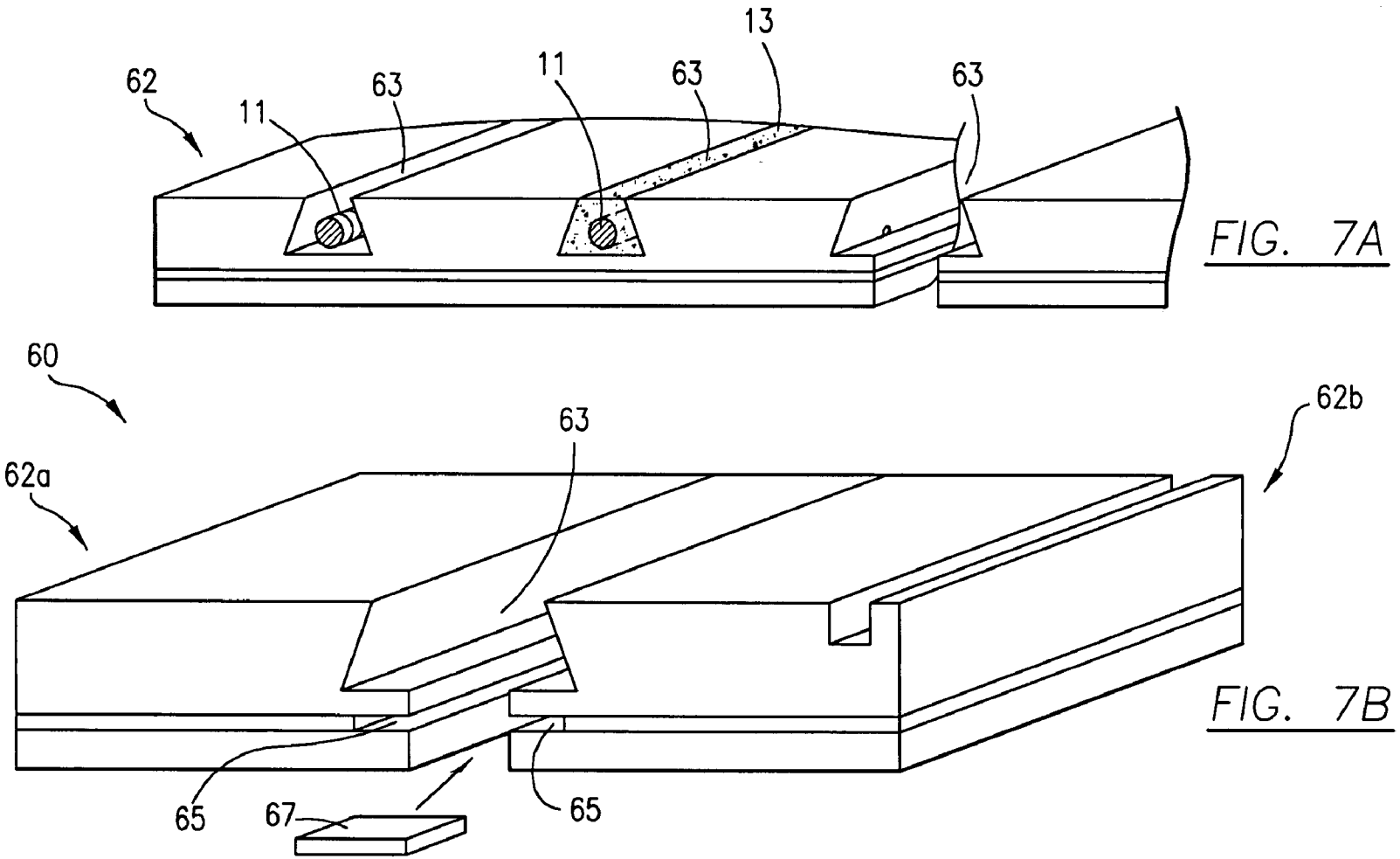
FIG. 7A shows a perspective view partially cut away of an exemplary roof panel according to the present invention.
FIG. 7B shows a perspective exploded view of a roof panel according to the present invention with the inclusion of insert connectors.

FIGS. 7A and 7B show the basic roof panel assembly according to the present invention. FIG. 7A shows the roof panel 62 which includes roof channels 63 to receive concrete and/or rebar running parallel across the panel 62. FIG. 7B shows the roof assembly 60, which includes roof panel 62*a*, roof panel 62*b* and connection insert block 67. The roof panels 62*a*, 62*b* both include a roof connection slot 65. The roof connection slot 63 travels around the perimeter of the roof panels 62*a*, 62*b*. A connection insert block 67 is placed within the roof connection slot 65 of the roof panel 62 so that several roof panels 62 can be joined together to form a roof assembly 60. The channels 63 within the roof panel 62 also allow for the insertion of rebar and cementitious material. The rebar placed into the channels 63 may be fastened to the existing bond beam structure, and cementitious materials may fill the channels 63 containing the rebar.

FIG. 7B shows a rebar 11 placed in channel 63 and rebar 11 with cementitous material 13 also disposed in the adjacent channel 63 all of which is used to tie the roof to the wall sections for tying the building together.

Figure 8A:
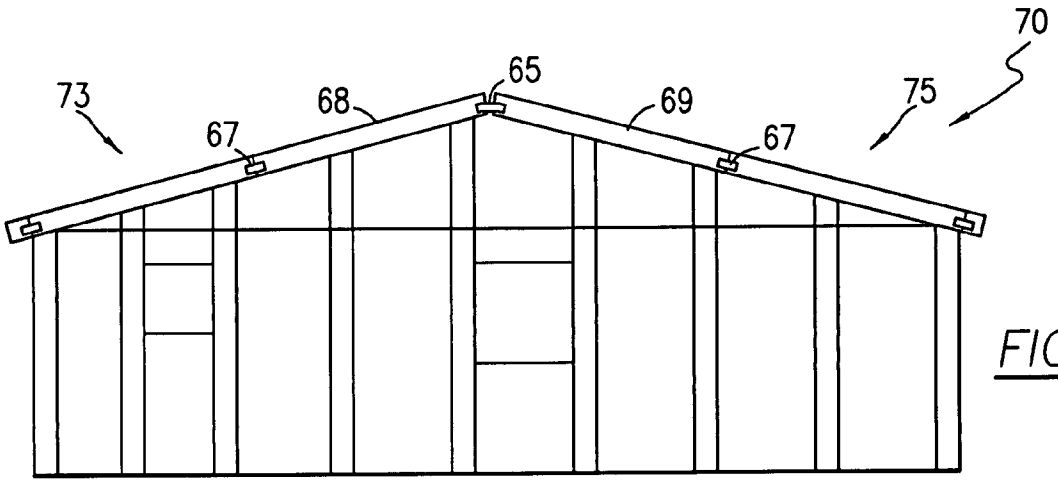
FIG. 8A shows a side elevational view schematically of joined roof peak according to the present invention.
Figure 8B:
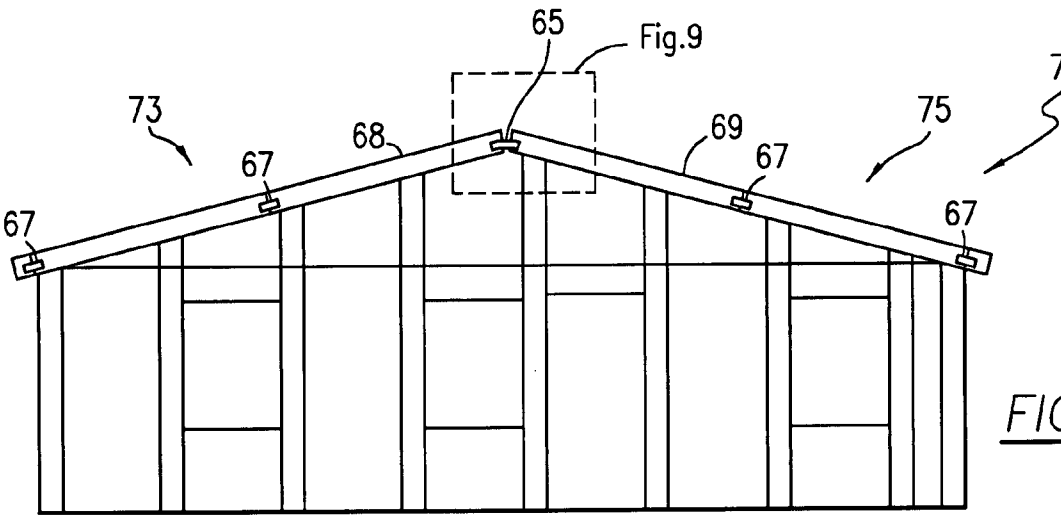
FIG. 8B shows a different side elevational view of a roof peak just prior to joining the roof peak panels according to the present invention.
Figure 9:
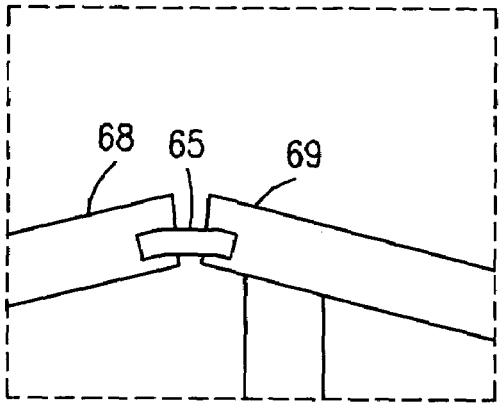
FIG. 9 shows an enlarged cut away side elevational view schematically of a gable roof peak according to the present invention.

FIGS. 8A and 8B show the end and opposite end elevations of a gable style roof that may be created with the roof peak connections 68, 69. A plurality of roof panels 73, 75 are connected and joined at the roof connector 65. Peak connection panels 68 and 69 are shown as connected at a roof peak in FIG. 8B. FIG. 9 shows a detail of a typical roof peak connection. A roof connector 65 joins peak connection panels 68 and 69 and demonstrates an exemplary roof peak as used with the gable style roof as shown in FIG. 9.

Figure 10:
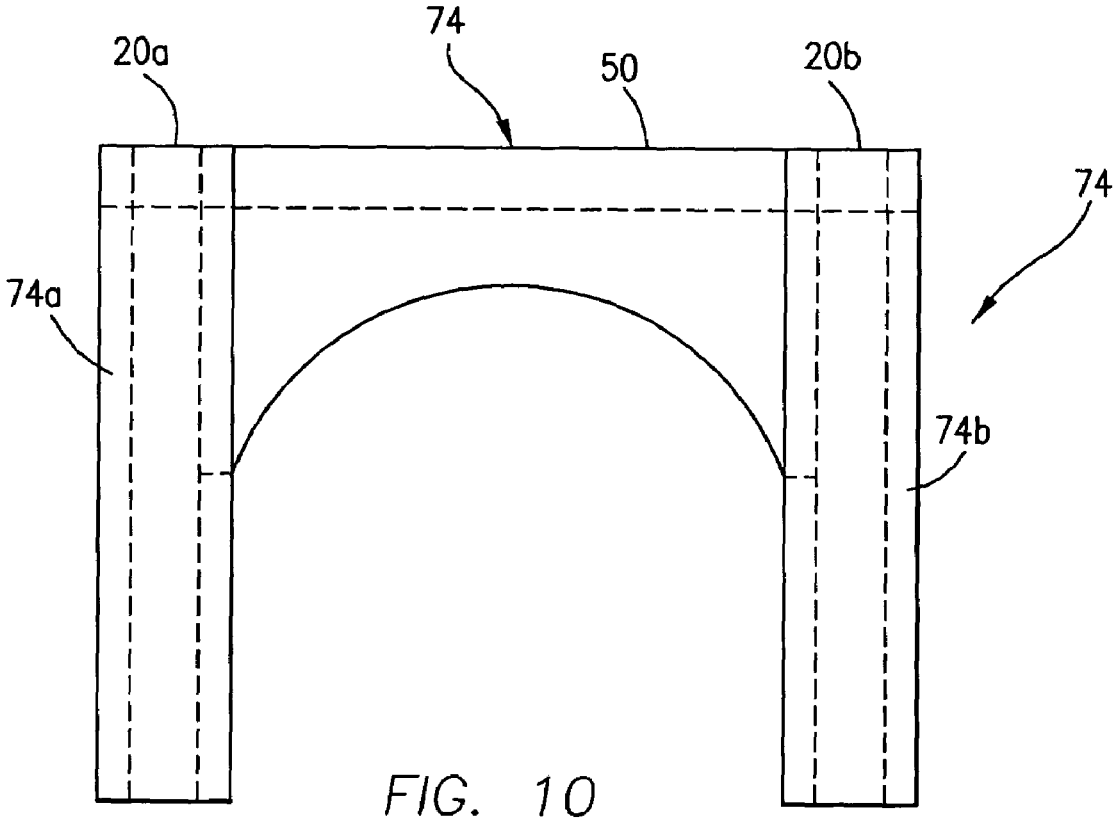
FIG. 10 shows a front elevational view of an arch insert according to the present invention that can be used for building constructions.

FIG. 10 shows an arch detail 74 that may be used as an entranceway into the completed building assembly. The arch detail 74 may be constructed with the use of slotted interior panels 20*a*, 20*b* and the header panels 50 as described above. The arch 74 includes side slots 74*a* and 74*b* for connection within wall interconnecting edges 11*a* and 11*b*.

Figure 11A:
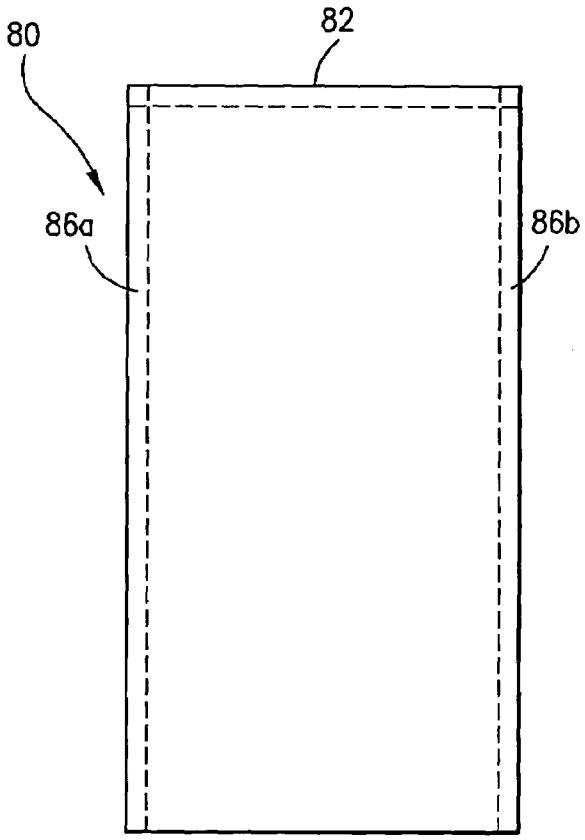
FIG. 11A shows a front elevational view of an interior wall according to the present invention.
Figure 11B:
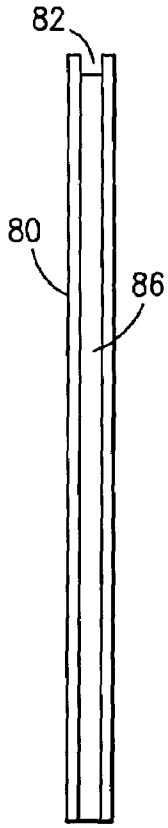
FIG. 11B shows a side elevational view of an interior wall according to the present invention.
Figure 11C:
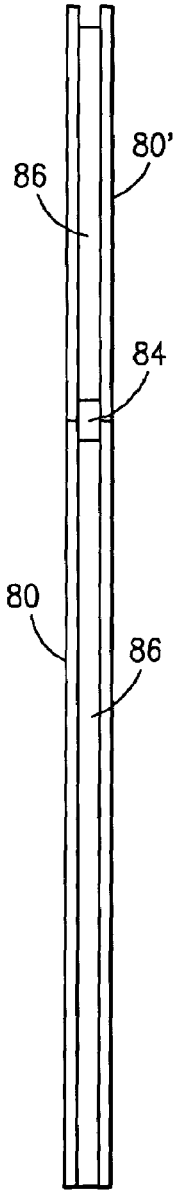
FIG. 11C shows two a side elevational view of interior walls stacked according to the present invention.

FIGS. 11A, 11B and 11C show an interior wall panel constructed of polystyrene according to the present invention. Interior wall panel 80 includes connection slots 86*a* and 86*b* along the sides thereof with a slot 82 running horizontal across the top of the wall panel 80. A side view of the interior wall panel 80, as shown in FIG. 11B, gives clear view of the slot 82 and the connection slot 86. FIG. 11C shows a connection of two interior wall panels 80 and 80'. As shown wall panels 80 and 80' are connected with a rigid connector piece 84 which inserts into the connection slot 82. In addition to the connection piece 84, adhesive is used to permanently affix two interior wall panels 80, 80' as shown in FIG. 11C.

FIG. 12A shows connections associated with the interior walls 80 according to the present invention. FIG. 12A shows a perspective view exploded of interior walls 80 and 80' being connected with the connector piece 84 as inserted into the connection slots 86, 86*a* of each respective interior wall. In addition to the connector piece 84, adhesive is applied within the slots 86 and upon the connector piece 84 in order to permanently affix the interior walls 80 and 80'. FIG. 12A shows an exploded perspective view of connector piece 84. The connector piece 84 may be used for insertion within the connection slots 86 of the interior walls 80 or within the connection slot 82 which runs across the top and bottom of interior walls 80. FIG. 12B shows a top plan view of an exemplary connection of the interior walls to a corner block 92, described in more detail in FIG. 16. As shown in FIG. 12B, connector piece 84 inserts into the channel 86 of interior wall 80 and into the channel within the corner block on each respective side of the corner block to adjoin interior walls. As associated with the connection of two interior walls, adhesive is also used for the connection of corner blocks and interior walls. The connection of interior walls may also be accomplished through the use of H blocks and corner blocks as described above with the exterior panels. Use of H blocks and corner blocks for interior panels may provide additional reinforcement and support for the interior panel assembly. FIG. 12C shows insert block 84 mounted in wall 80.

FIGS. 13A, 13B, 13C and 13D show an exemplary interior T block. FIG. 13A shows the top view of interior T block 90 that includes channels 91*a*, 91*b* and 91*c*. As discussed above and in association with the interior corner block, the connector piece 84 is inserted between the slots of an interior T block and the slot of the interior wall 80 to provide a means for connection thereof. FIG. 13B shows a front view of the interior T block, which provides a clearer view of the connection slot 91*b*. FIGS. 13C and 13D show respective side views of the interior T block 90 according to the present invention.

Figure 14A:
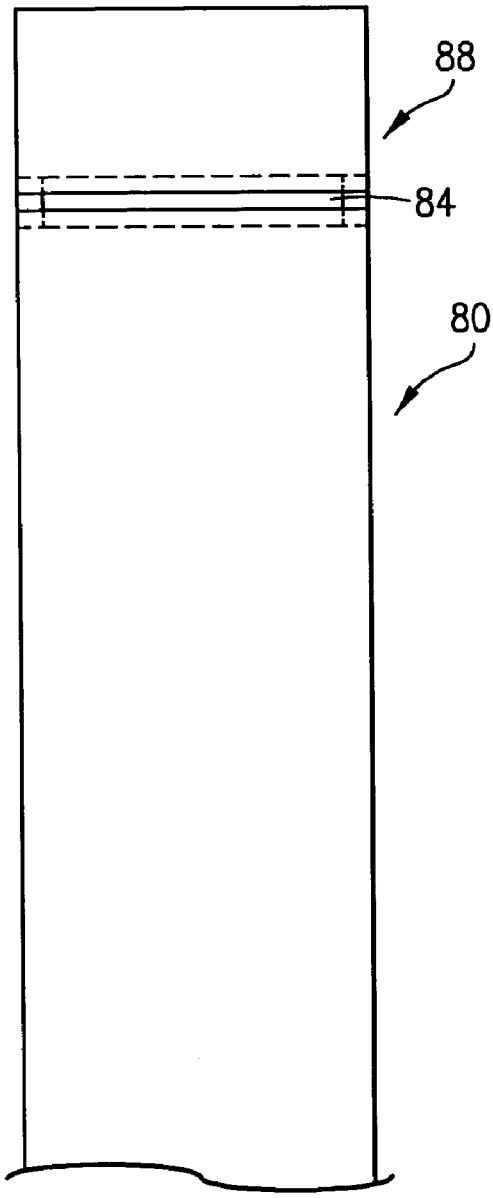
FIG. 14A shows a front elevational view of an interior wall panel connected to a header according to the present invention.
Figure 14B:
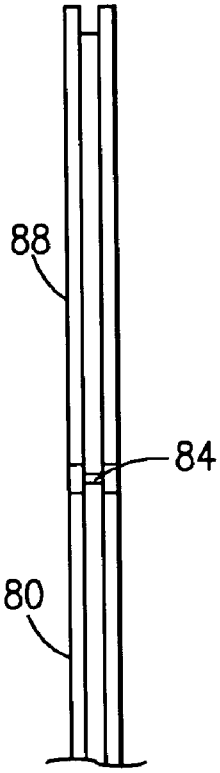
FIG. 14B shows a side elevational view of the connection of the header and interior panel according to the present invention shown in FIG. 14A.

FIGS. 14A and 14B show an exemplary interior ceiling/header panel connection. FIG. 14A shows a front view of the connection of interior panel 80 with the header 88 attached to the top thereof. As associated with the vertical connection of interior walls, interior wall 80 is connected to the header 88 by means of a connector piece 84 inserted within the connection slot 82 of the interior wall with a complimentary slot provided in the header 88. FIG. 14B provides a side view of the connection of interior wall 80 and header 88.

Figures 15A, 15B:
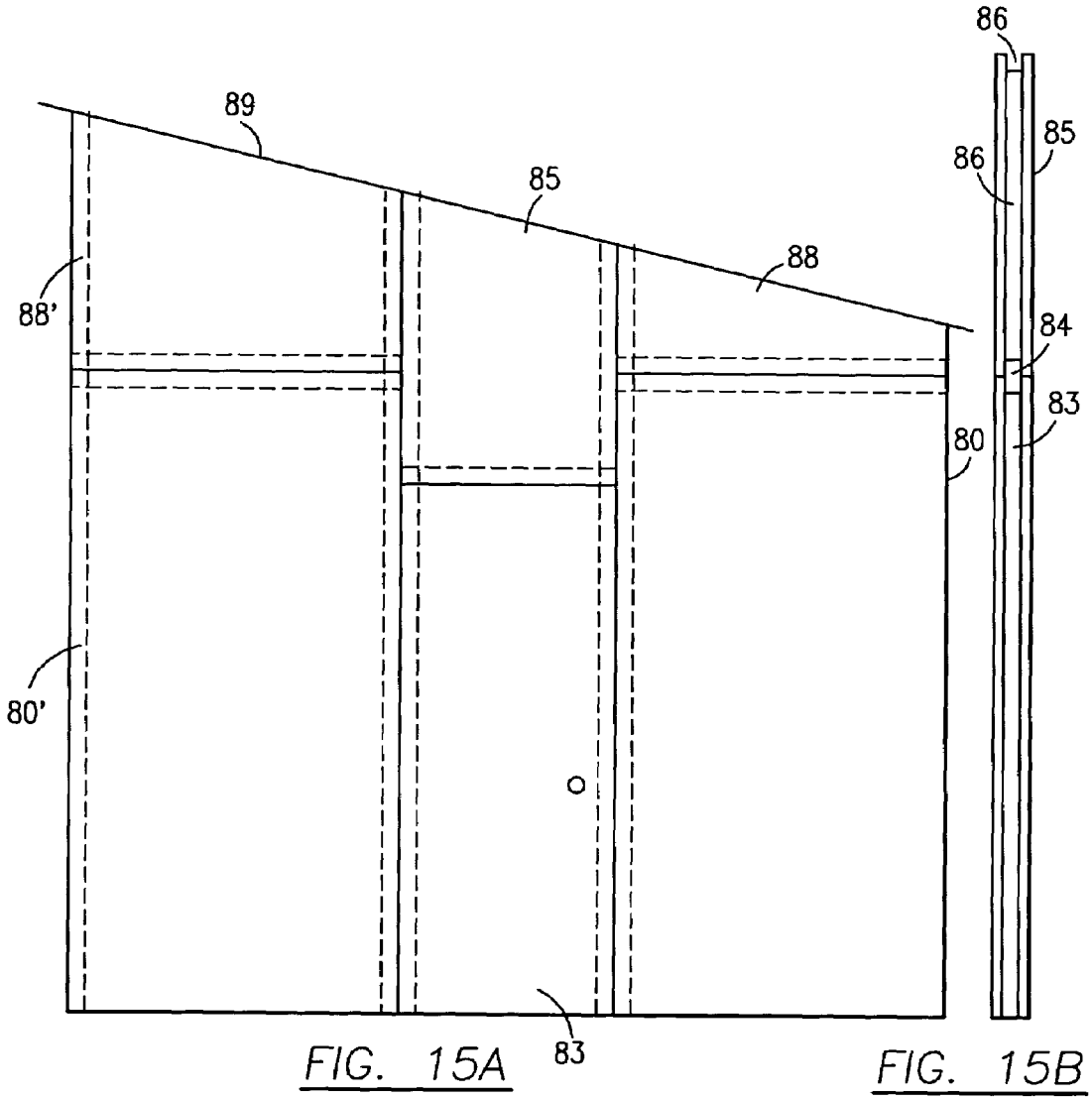
FIG. 15A shows a front elevational view of an exemplary interior door with a door header and interior wall panels surrounding it.
FIG. 15B shows a side elevational view of the header interior wall connection.

FIGS. 15A and 15B show a front elevational view of a door entrance according to the present invention. FIG. 15A shows a door 83 surrounded by two interior wall panels 80 and 80' on each side thereof of the door. A door header 85 is atop of the door with two adjacent ceiling wall panels 88 and 88'. As shown, ceiling wall panels are respectively connected to each interior wall 80 and 80' and are pitched in order to abut to the ceiling 89. The door header panel 85 is also pitched in order to accommodate the ceiling 89. FIG. 15B shows a side view of the door header 85 and top door jam connection. As previously shown with the vertical connection associated with interior walls 80, the door header 85 and top of the door jam are connected via a connection piece 84 inserted into a connection slot provided within the door header. A coating may be applied over the wall panel and door jam/header connections to bond the connection.

Figure 16A:
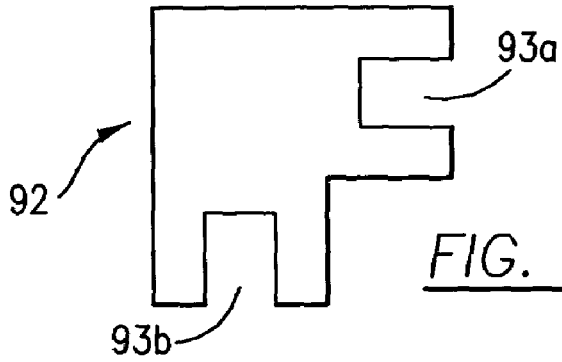
FIG. 16A shows a top plan view of the interior corner block according to the present invention.
Figure 16B:
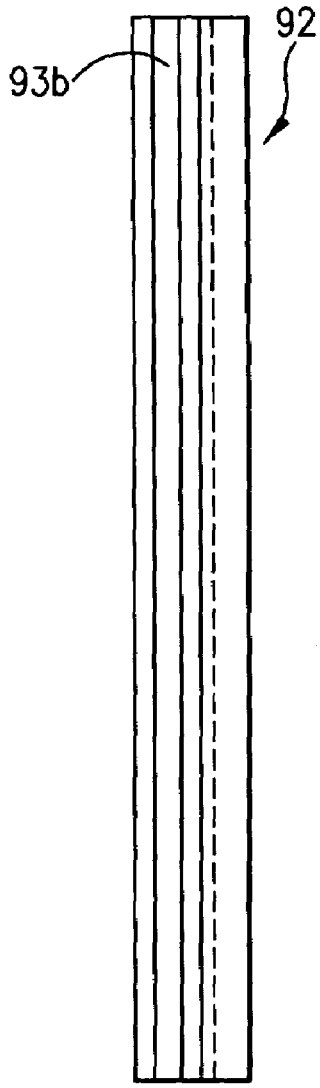
FIG. 16B shows a front elevational view of the interior corner block according to the present invention.
Figure 16C:
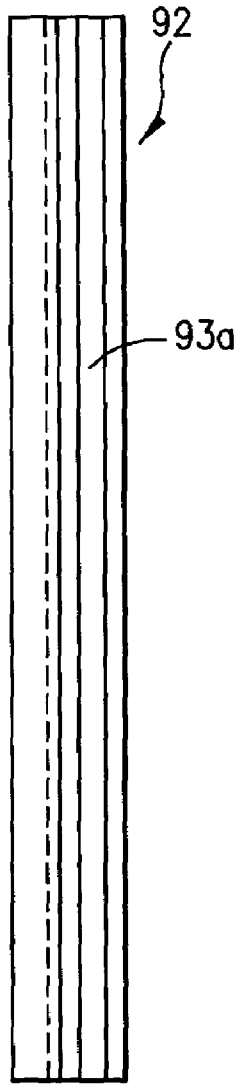
FIG. 16C shows a side elevational view of the interior corner block according to the present invention.

FIGS. 16A, 16B, and 16C show an exemplary interior corner block 92. FIG. 16A shows a top plan view of the interior corner block 92 which includes channels 93*a* and 93*b*. The channels 93*a* and 93*b* provide for the insertion of the connector piece 84 and for the connection of interior walls 80 to the interior corner block 92. FIGS. 16B and 16C show the two views (front and side) associated with interior corner block 92.

Figure 17A:
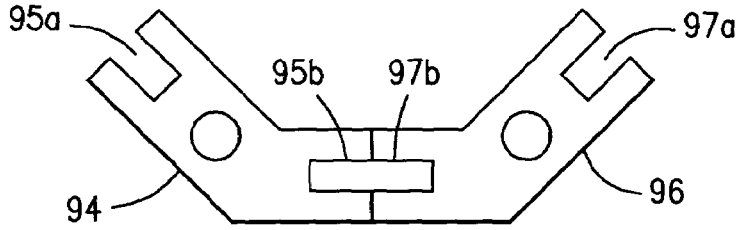
FIG. 17A shows a top plan schematic view of 45-degree angle connection block according to the present invention.
Figure 17B:
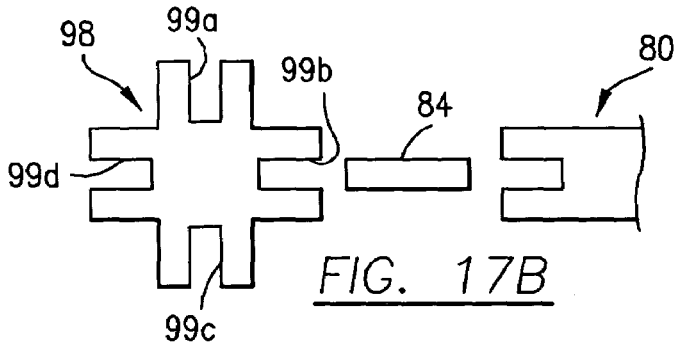
FIG. 17B shows a top plan schematic exploded view of an interior four-way block as it connects an interior panel according to the present invention.
Figure 17C:
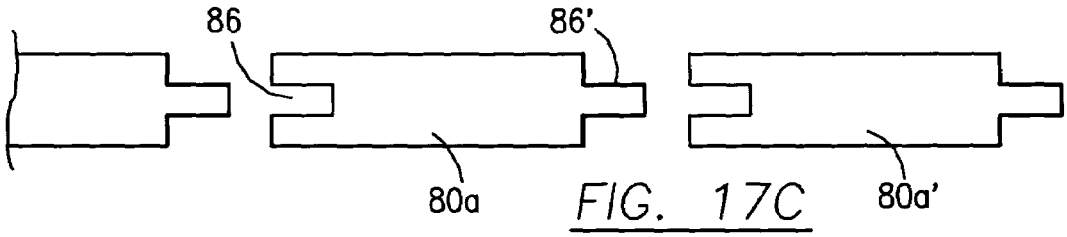
FIG. 17C shows a top plan schematic exploded alternative embodiment interior wall connection according to the present invention.

Other connection means are shown in FIGS. 17A, 17B and 17C for the exterior walls 80. A 45 degree connection block is shown in FIG. 17A which includes two adjoining 45 degree blocks 94 and 96 which each have connection slot associated with them, 95*a*, 95*b* for the 45 degree block 94 and connection 97*a*, 97*b* for the 45 degree block 96. FIG. 17B shows an exemplary four-way interior block 98 which includes four channels 99*a*, 99*b*, 99*c*, and 99*d* for the insertion of connector piece 84 and to provide a connection means for interior walls 80. FIG. 17C shows alternative interior wall 80*a* which includes a female connection slot 86 and a male interlocking edge 86' which adjoins with a receptive connection channel 86 of a targeted interior wall 80*a'*.

Interior walls 80 may utilize the interlocking panel system as described above. Only structural walls will receive the H block 20*a*, 20*b* or structural corner block 92. Once completely assembled and the utility chases and components have been placed into the building structure the structure's surface area will be encapsulated with a cementitious coating that will give the structure rigidity. Dry wall can be glued to the styrene panels without cementitious encapsulation. Also, studs could be employed to attach drywall to frame against the polystyrene. The interior could also be standard.

Figure 18A:
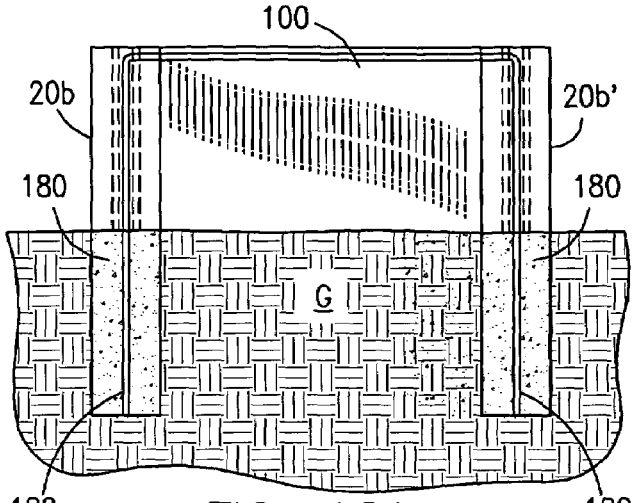
FIG. 18A shows a front elevational view partially in cross section of perimeter wall fence according to the present invention.
Figure 18C:
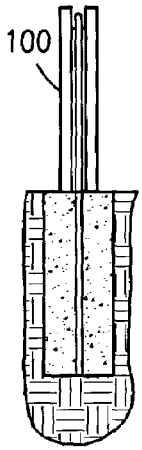
FIG. 18C shows a side elevational view of the perimeter wall according to the present invention.
Figure 18B:
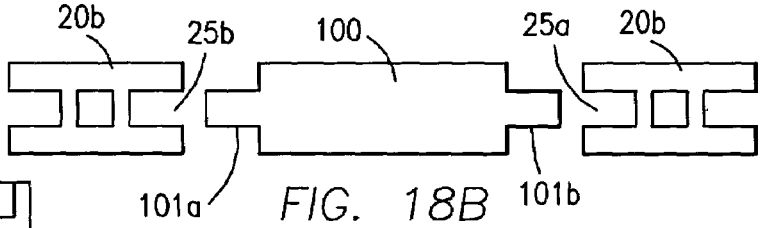
FIG. 18B shows a top plan exploded view of the connection of perimeter walls according to the present invention.
Figure 18D:
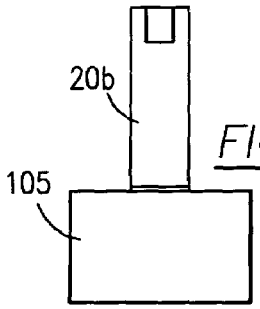
FIG. 18D shows a side schematic view detail of the footer associated with the perimeter wall according to the present invention.
Figure 18E:
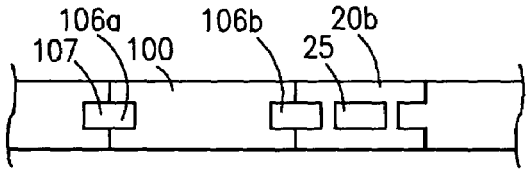
FIG. 18E shows a top plan schematic view of the connection of the perimeter wall panels using an H block with a post according to the present invention.
Figure 18F:
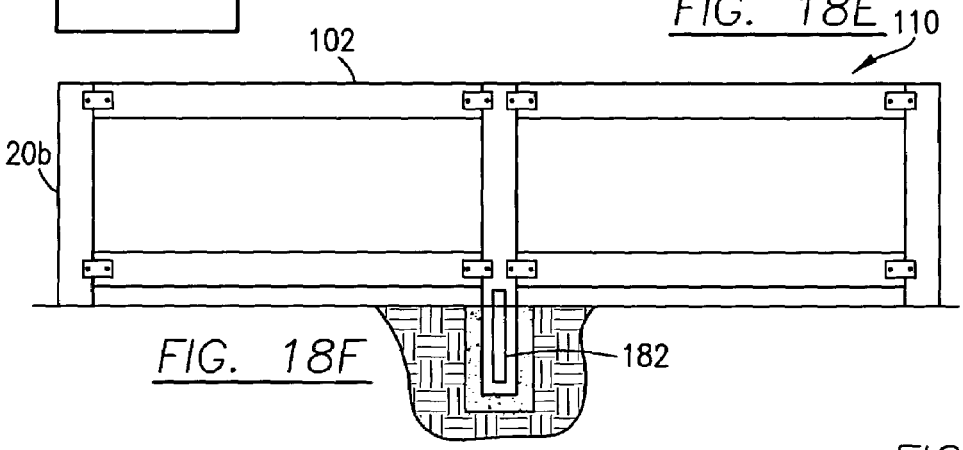
FIG. 18F shows a front elevational view of a wood beam detail associated with the perimeter wall according to the present invention.
Figure 18G:
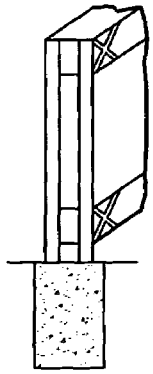
FIG. 18G shows a perspective cut away view of the wood beam detail according to the present invention.

FIGS. 18A, 18B, 18C, 18D, 18E, 18F, and 18G show detailed views associated with perimeter walls according to the present invention. FIG. 18A shows a front view of two H blocks 20*b* being used with a perimeter panel 100. As shown in FIG. 18A, the H blocks 20*b*, 20*b*' sit on top of a footer 180 in the ground G and are supported by the footer 180 as shown in FIGS. 18A and 18D. FIG. 18B shows a top view of the perimeter wall connection where the perimeter wall 100 is shown as being interconnected between the H blocks 20*b*, 20*b*' where the female slots 25*b* and 25*a*' receive male interlocking edges 101*a* and 101*b* of the perimeter wall 100. Rebar 182 is anchored in concrete. FIG. 18D shows a detail of the H block 20*b* mounted on top of cement post hole 105. FIG. 18C shows the detail of H block footer 20*b* extending into the ground into the concrete footer 105 along with the use of a rebar inserted through the rectangular void 23 of the H block 20*b*. FIG. 18E shows a top view of the connection of the H block 20*b* with perimeter panel 100 wherein the use of connector posts 107 is provided. The perimeter wall of FIG. 18E includes connection channels 106*a* and 106*b* as opposed to the interlocking edges shown in FIG. 18B. The connector posts 107 are inserted within the connection channel 106 in order to provide support for the perimeter wall 100. FIG. 18F shows a wood beam perimeter fence 110 according to the present invention. The fence 110 includes the use of H blocks 20*b* and perimeter beams 102. The perimeter wooden beams 102 are horizontally attached to the inside of the H block posts used for the construction of the wood beam fence 110. FIG. 18G shows a perspective side view of the perimeter beam connections with the H blocks 20*b* of the present invention.

Figure 19A:
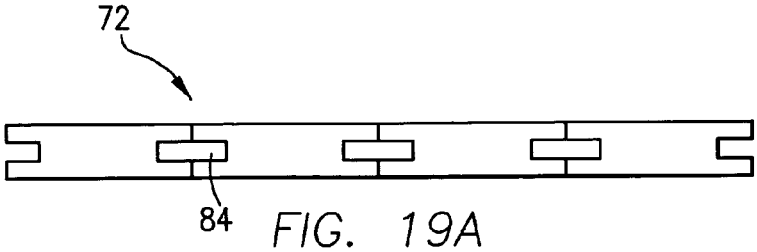
FIG. 19A shows a side elevational schematic view of a flat ceiling detail according to the present invention.
Figure 19C:
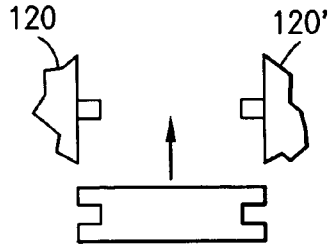
FIG. 19C shows a side elevational exploded view schematically of a header extension to the roof line according to the present invention.
Figure 19B:
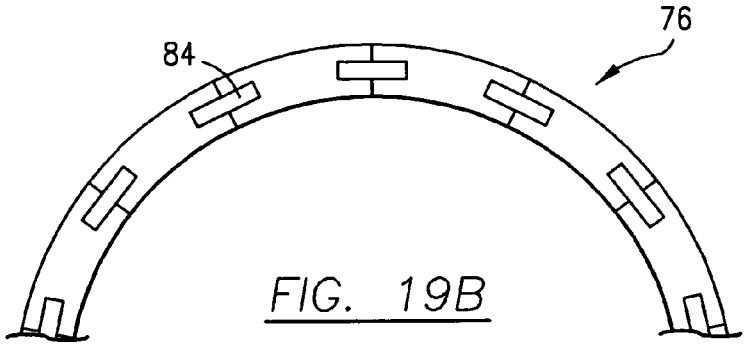
FIG. 19B shows a side elevational schematic view of a barrow vault detail of a ceiling according to the present invention.
Figure 19D:
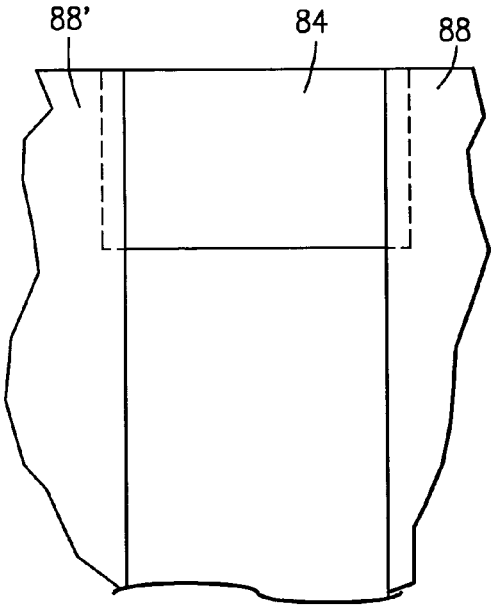
FIG. 19D shows a top plan view partially cut away of an interior header detail according to the present invention.

FIGS. 19A, 19B, 19C and 19D show some further alternative connection schemes associated with the present invention. FIG. 19A shows the use of a flat ceiling detail 72 where interior panels are shown with the use of connector 84 connected in a straight line. FIG. 19A shows a side view and shows the use as associated with a gable type roof as shown in FIG. 18C. The use of a flat ceiling 72 creates attic space storage or insulation purposes. FIG. 19B shows a barrow vault detail 76, which includes interior walls 80, respectively curved, and used with the connector 84 to provide the connection means for the barrow vault detail 76. FIG. 19C shows exemplary end connection pieces 120, 120' that receive the respective ceiling panels of the flat ceiling 72. FIG. 19D shows a top view of the header 85 used for the door header panel as was shown in FIG. 15. The door header 85 of FIG. 19D connects to the interior panels 88 and 88' by means of connector piece 84 and thus provides for the door header assembly.

Figure 20:
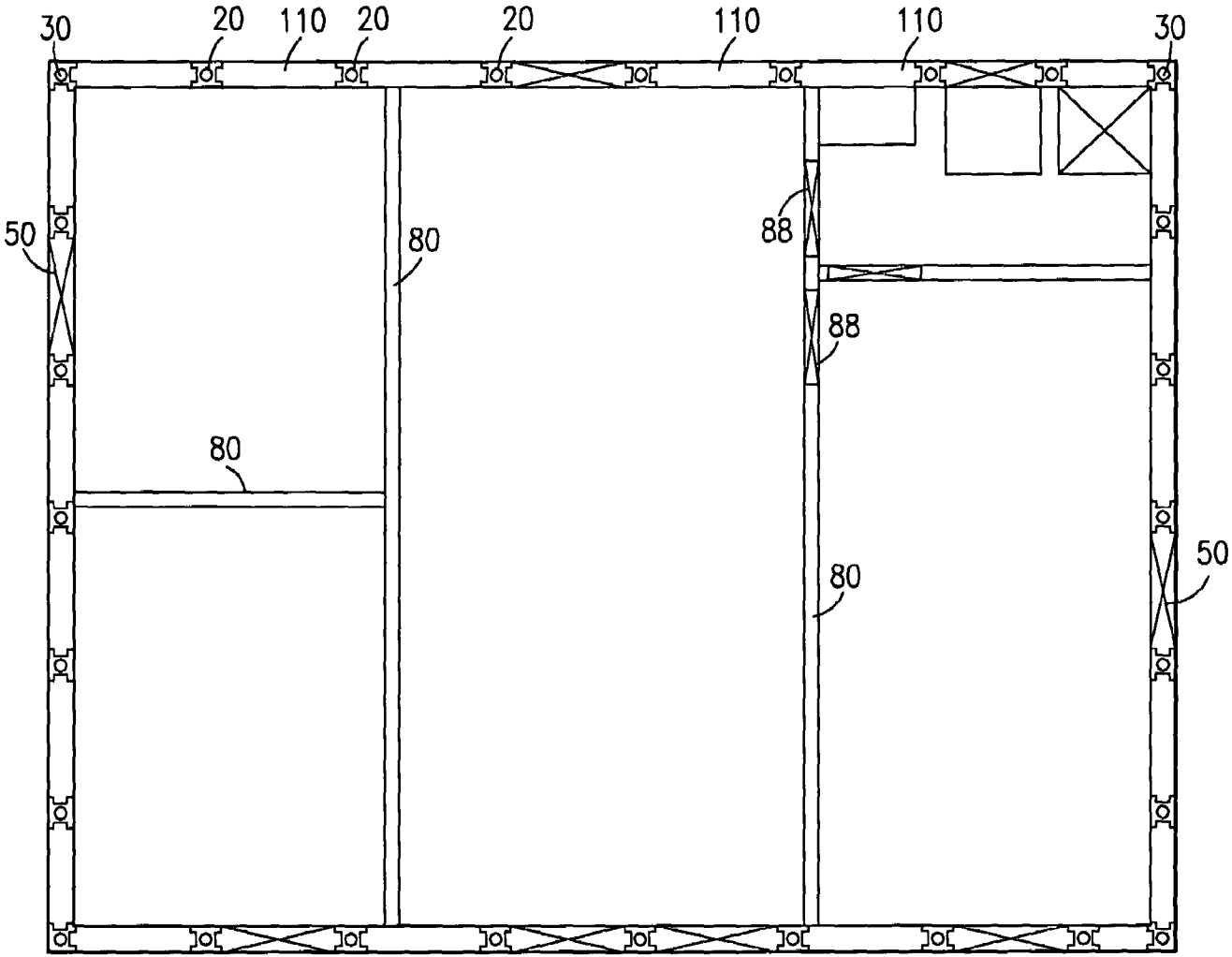
FIG. 20 shows a top plan view schematically in cross section of a building assembly.

FIG. 20 shows a schematic plan view of the prefabricated building assembly according to the present invention where a plurality of exterior walls 110 are connected by using H blocks 20 and corner blocks 30. In addition to the exterior panels 110 windows are formed at header panels 50 shown along the exterior wall construction. The interior rooms are formed by partitions created by interior walls 80 and interior doors are shown with header panels 88.

Figure 21B:
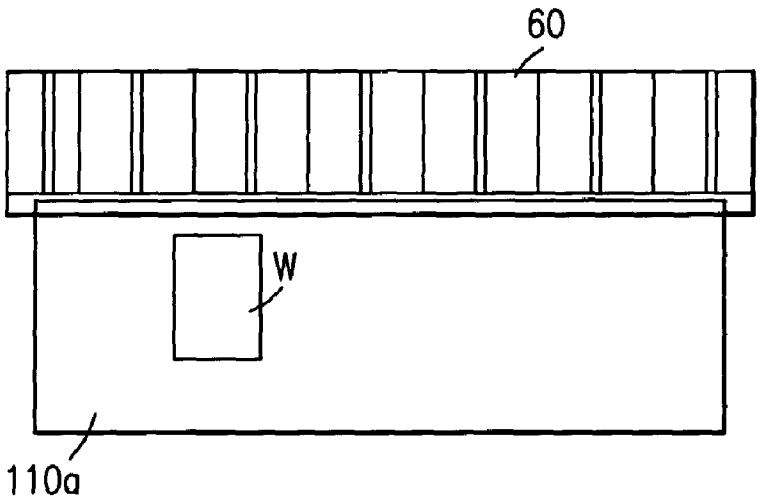
FIG. 21B shows a front elevational view as in FIG. 21A with the cementitious coating as a finished building assembly.
Figure 21A:
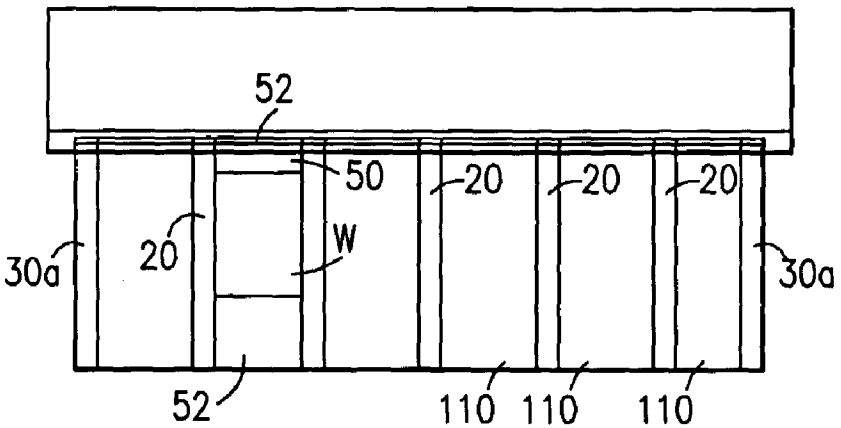
FIG. 21A shows a front elevational view of the building assembly before additional of a cementitious coating on the panel surfaces.

FIGS. 21A and 21B show elevation views partially completed (FIG. 21A) of the completed building and assembly FIG. 21B according to the present invention. FIG. 21A shows an exterior wall assembly including corner blocks 30*a* at each end of the exterior wall assembly where exterior panels 110 are supported with and connected by H blocks 20. A window W is shown with a header 50 and seal panel 52. FIG. 21B shows the exterior wall 110*a* which is covered with a cementitious material and shown in its completed form. FIG. 21B shows the plurality of roof panels that are connected through the use of plurality of roof connectors and roof panels in order to form roof assembly 60.

The roof may be covered with standard materials on top such as plywood, shingles or other covering. Plywood may be placed upon the roof panels and attached to the cementitious channels within the roof panels. The plywood could then be covered with standard roofing materials.

The exterior walls may have a brick exterior for aesthetics in certain locations without coating the walls. Prior to coating the exterior walls with the cementitious coating, the exterior walls may be finished with any number of standard building materials such as brick or vinyl siding which may be attached to the building assembly in lieu of the cementitious coating. The present invention disclosed a unique building assembly and method to construct low cost, thermally efficient housing in remote locations that are quick and simple to assemble. This invention is a great benefit to provide large scale housing to large numbers of people at low cost throughout the world.

Although in the preferred embodiment the panels, corners and blocks have been shown with interlocking edges used in conjunction with upper recesses that receives rebar and cementitious material, in an alternate embodiment there may be circumstances that an exterior wall panel will be joined together with flat sides of faces by an adhesive as opposed to an interlocking edge. In that situation, the wall panel corner, H-block, 45 degree block, header, sill, three-way block, four-way block, wall panel, and roof panel channel piece could under certain circumstances have flat sides and the faces of those flat sides will be joined together by an adhesive.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A prefabricated building assembly for construction of a low cost building comprising:

a plurality of exterior Styrofoam wall panels;

a plurality of exterior Styrofoam connection blocks, said plurality of exterior connection blocks connected to said plurality of exterior wall panels to form an exterior wall of a building;

a plurality of Styrofoam roof panels, said plurality of roof panels joined together forming a roof of the building; and said walls having channels that receive cementitious material and rebar to anchor the exterior walls and roof together for structural rigidity; and said plurality of exterior wall panels each including at least one male protruding interlocking edge, said at least one interlocking edge provides an appendage for inserting an exterior connection block.

2. The prefabricated building assembly according to claim 1, said plurality of exterior wall panels each including at least one connection slot which receives a connecting exterior wall panel to provide for vertical stacking of said plurality of exterior wall panels.

3. The prefabricated building assembly according to claim 1, where said plurality of exterior walls includes a top portion which is angled for roof engagement with a pitched roof.

4. The prefabricated building assembly according to claim 1, where said plurality of exterior connection blocks includes at least one H block, said at least one H block including two channels, said two channels capable of receiving said at least one interlocking edge.

5. The prefabricated building assembly according to claim 4, wherein said at least one H block includes an orifice extending through the length of the at least one H block.

6. The prefabricated building assembly according to claim 5, wherein said orifice is substantially rectangular.

7. The prefabricated building assembly according to claim 5, wherein said orifice is substantially cylindrical.

8. The prefabricated building assembly according to claim 1, where said plurality of exterior connection blocks includes at least one corner block, the at least one corner block including two channels on two adjacent sides of said corner block, said two channels capable of receiving said at least one interlocking edge.

9. The prefabricated building assembly according to claim 8, where said at least one corner block includes an orifice extending through the length of the at least one corner block.

10. The prefabricated building assembly according to claim 9, where the orifice is substantially rectangular.

11. The prefabricated building assembly according to claim 9, where the orifice is substantially rectangular.

12. The prefabricated building assembly according to claim 1, where said plurality of exterior connection blocks includes at least one four way block, the at least one four way block including channels on each side of said four way block, said channels capable of receiving said at least one interlocking edge and a channel for cementitious material.

13. The prefabricated building assembly according to claim 12, where said at least one four way block includes an orifice extending through the length of the at least one four way block.

14. The prefabricated building assembly according to claim 1, where said plurality of exterior connection blocks includes at least one three way block, the at least one three way block including channels on each side of said three way block, said channels capable of receiving said at least one interlocking edge.

15. The prefabricated building assembly according to claim 14, where said at least one three way block includes an orifice extending through the length of the at least one three way block.

16. The prefabricated building assembly according to claim 15, where the orifice is substantially rectangular.

17. The prefabricated building assembly according to claim 1, where said plurality of exterior wall panels are about 8 feet in height and vary in length.

18. The prefabricated building assembly according to claim 1, where said plurality of roof panels each include a plurality of parallel roof connection slots.

19. The prefabricated building assembly according to claim 1, further comprising:

a plurality of interior wall panels; and an interior connection piece, where each interior wall panel includes channels, said channels providing a means for the insertion of the interior connection piece.

* * * * *